US007956019B2

(12) United States Patent
Saito et al.

(10) Patent No.: US 7,956,019 B2
(45) Date of Patent: Jun. 7, 2011

(54) LUBRICANT FOR A HOT PLASTIC WORKING

(75) Inventors: Kenichi Saito, Wakayama (JP); Tetsuya Nakanishi, Musashino (JP)

(73) Assignee: Sumitomo Metal Industries, Ltd., Osaka-shi (JP)

( * ) Notice: Subject to any disclaimer, the term of this patent is extended or adjusted under 35 U.S.C. 154(b) by 279 days.

(21) Appl. No.: 12/281,458

(22) PCT Filed: Mar. 14, 2007

(86) PCT No.: PCT/JP2007/055140

§ 371 (c)(1), (2), (4) Date: Nov. 14, 2008

(87) PCT Pub. No.: WO2007/105774

PCT Pub. Date: Sep. 20, 2007

(65) Prior Publication Data

US 2009/0215655 A1 Aug. 27, 2009

(30) Foreign Application Priority Data

Mar. 14, 2006 (JP) ..... 2006-069384

(51) Int. Cl.
*C10M 125/10* (2006.01)
*C10M 125/28* (2006.01)

(52) U.S. Cl. ..... 508/136; 508/484; 508/171; 508/154

(58) Field of Classification Search ..... 508/136, 508/171, 172, 154, 484
See application file for complete search history.

(56) References Cited

U.S. PATENT DOCUMENTS

| | | | | |
|---|---|---|---|---|
| 1,951,039 | A * | 3/1934 | Scharschu | 148/537 |
| 1,982,179 | A * | 11/1934 | Scharschu | 428/450 |

FOREIGN PATENT DOCUMENTS

| | | | | |
|---|---|---|---|---|
| JP | 60-21111 | A | | 2/1985 |
| JP | 61217515 | A | * | 9/1986 |
| JP | 61-223096 | A | | 10/1986 |
| JP | 3-91596 | A | | 4/1991 |
| JP | 04-331292 | A | | 11/1992 |
| JP | 07-126684 | A | | 5/1995 |
| JP | 10-130687 | A | | 5/1998 |
| JP | 11-035967 | A | | 2/1999 |

OTHER PUBLICATIONS

International Preliminary Report on Patentability in corresponding PCT/JP2007/055140 issued Sep. 16, 2008.

International Search Report in corresponding PCT/JP2007/055140 issued Jun. 17, 2007.

Written Opinion in corresponding PCT/JP2007/055140 issued Jun. 17, 2007.

* cited by examiner

*Primary Examiner* — Glenn Caldarola
*Assistant Examiner* — Jim Goloboy
(74) *Attorney, Agent, or Firm* — Marshall, Gerstein & Borun LLP

(57) ABSTRACT

To provide a lubricant for hot plastic working which is excellent in lubricating properties, feedability and operability and will produce no adverse affects on the corrosion resistance of the products.

A lubricant for hot plastic working which is characterized in that the composition is comprised of, in an anhydrous condition, 50 to 80% by mass of iron oxide, 20 to 50% by mass of sodium silicate and 1 to 20% by mass of calcium oxide and that the total content of the impurities of zinc oxide, lead oxide and copper oxide is not higher than 5% by mass, where the content of the stabilizer is not counted. This lubricant is suited for use in lubricating guide shoes in piercing-rolling of high-Cr steel species.

1 Claim, No Drawings

LUBRICANT FOR A HOT PLASTIC WORKING

TECHNICAL FIELD

The present invention relates to a lubricant for reducing the friction between the materials to be worked and the working members in contact with it during hot working and preventing the sticking thereof on a hot working apparatus and, particularly, to a lubricant which reduces the friction between the steel materials such as a billet and pipe to be worked and the guide shoes of a piercer, and preventing the sticking thereof during steel pipe manufacturing.

BACKGROUND ART

During steel pipe manufacturing by the Mannesmann process, a piercer works a billet where the outer surface of the billet is in contact with guide shoes. Therefore, if the lubrication between the outer surface of the billet and the guide shoes is inadequate, sticking will damage the guide shoes themselves, and the outer surface of the pierced crude pipe (hereinafter referred to as "hollow shell") will suffer damages due to sticking which are called shoe marks.

There are two types of guide shoes, fixed plate type and rotary disk type. In either case, it is very important to maintain a good supply of lubrication to prevent such sticking. Thus, there are some proposals regarding the method of lubrication, as follows.

In Patent Document 1, a piercing-rolling method is disclosed, which comprises applying a mixed coating composition that is comprised of a metal oxide, a powder-based anti-sticking material and a binder.

In Patent Document 2, a lubricant for hot rolling of stainless steel species is disclosed, which is comprised of an iron oxide powder, a water-soluble acrylic polymer and a surfactant.

In Patent Document 3, a lubricant for hot working is disclosed, which is comprised of iron oxide, sodium silicate, starch species and xanthan gum.

However, in the case of piercing a hard-workable material such as a 13% Cr steel species, the lubricants disclosed in these documents cannot reduce the friction between the guide shoes and the hollow shell to a sufficient extent, and therefore cannot prevent the occurrence of damages due to sticking to a satisfactory extent.

[Patent Document 1] JP-A-S60-21111

[Patent Document 2] JP-A-H07-126684

[Patent Document 3] JP-A-H11-35967

DISCLOSURE OF INVENTION

Problems to be Solved by the Invention

The lubricant for hot plastic working is required to have sufficient lubricating properties to prevent sticking. In addition, the lubricant, when used, is required to be fed smoothly to the area requiring lubrication. Thus, it is required to have good availability or feedability. Furthermore, it must not cause an operational problem such as roll slipping in piercing and rolling. Thus, it must be excellent in operability as well. Furthermore, even when the lubricant remains on the product surface after working, it must not weaken corrosion resistance.

It is an objective of the present invention to provide a lubricant for hot plastic working, which is excellent not only in lubricating properties but also in such feedability and operability as mentioned above and which will not adversely affect the corrosion resistance of the product.

Means for Solving the Problems

The gist of the present invention consists in the following lubricant for hot plastic working.

A lubricant for hot plastic working which is characterized in that the composition is comprised of, in an anhydrous condition, 50 to 80% by mass of iron oxide, 20 to 50% by mass of sodium silicate and 1 to 20% by mass of calcium oxide and that the total content of the impurities of zinc oxide, lead oxide and copper oxide is not higher than 5% by mass, where the content of the stabilizer is not counted.

The contents of the respective components mentioned above are on an anhydrous condition basis. This lubricant is used in the form of an aqueous solution, and preferably about 400 to 1000 grams of the above lubricant is added to each liter of water, although the amount thereof may vary according to the working conditions.

In addition to the above-specified components, at least one of substances capable of improving the dispersion stability, such as sodium naphthalenesulfonate-formaldehyde condensates, styrene-maleic anhydride copolymer resin sodium salt, polyacrylic acid sodium salt, ethylene glycol alkyl ethers and polyethylene glycol alkyl phenyl ethers may be added as a stabilizer. The level of addition thereof is preferably about 20 to 100 grams per liter of water.

The lubricant, according to the present invention, is suited for use in manufacturing steel pipes using, in particular, steel species containing 8 to 25% by mass of Cr, for example SUS 420JI-equivalent steel, SUS 304-equivalent steel and 25Cr type duplex stainless steel.

BEST MODES FOR CARRYING OUT THE INVENTION

The lubricant, according to the present invention, has good lubricating properties owing to the combined action of the above-specified components. The respective components are described as follows.

(1) Iron Oxide:

Iron oxide is the main component for producing the anti-sticking effect. The iron oxide may be one of ferrous oxide (FeO), ferric oxide ($Fe_2O_3$) and triiron tetraoxide ($Fe_3O_4$) or a mixture of two or more of them. It is necessary that the iron oxide content should be 50 to 80% by mass. At levels lower than 50% by mass, sticking may occur. At levels exceeding 80% by mass, the amount of iron oxide relative to the binder (sodium silicate) content in the lubricant becomes excessive, which results in the lubricant becoming scarcely introducible into the sliding working interface or onto the tool surface; thus, the feedability, one of the performance characteristics required of the lubricant, deteriorates.

(2) Sodium Silicate:

Sodium silicate is a binder combining iron oxide particles as the main component and facilitating the introduction of iron oxide particles into the sliding interface. The amount thereof is 20 to 50% by mass on the anhydrous basis. Sodium silicate may also be added in the form of water glass. The water glass may be water glass No. 1 ($Na_2O:SiO_2$=1:2), water glass No. 3 ($Na_2O:SiO_2$=1:3) or water glass No. 4 ($Na_2O:SiO_2$=1:4). At levels lower than 20% by mass on the anhydrous basis, sodium silicate scarcely introduces iron oxide particles into the sliding working interface or onto the tool surface, and hence the feedability, one of the performance characteristics required of the lubricant, deteriorates. At levels exceeding 50% by mass, the binder content becomes excessive relative to the iron oxide as the main component and the anti-sticking effect of iron oxide is reduced accordingly.

(3) Calcium Oxide (CaO):

Calcium oxide forms a liquid phase in the sliding working interface and thus reduces the viscosity of the lubricant and improves the lubricating properties thereof. At calcium oxide content levels lower than 1% by mass, it cannot produce any friction coefficient-reducing effect. At levels exceeding 20% by mass, the friction coefficient is excessively reduced and roll slipping is readily induced.

(4) Zinc Oxide, Lead Oxide and Copper Oxide:

Zinc oxide (ZnO), lead oxide (PbO) and copper oxide (CuO) are impurities entrained by the above-mentioned iron oxide, and thus introduced into the lubricant. For example, when the pickling slime from the zinc plating line or steel slag is used as the raw material for iron oxide, zinc oxide gets mixed with the iron oxide. When the content of these in the lubricant is high and the lubricant remains on the product surface, the corrosion resistance of the product surface is weakened. At elevated temperatures, these oxides are more easily reduced than iron oxide and, therefore, when they remain on the product surface, they react with the steel itself constituting the product and weaken the corrosion resistance of the product.

On closer investigation of such phenomena as mentioned above, it was revealed that when the content of each or the total content of zinc oxide, and the lead oxide and copper oxide is not higher than 5% by mass, the corrosion resistance-decreasing effect thereof is insignificant. At levels exceeding 5% by mass, the anti-sticking performance of the lubricant also decreases.

(5) Other Components

As mentioned hereinabove, at least one of substances capable of improving the dispersion stability such as sodium naphthalenesulfonate-formaldehyde condensates, styrene-maleic anhydride copolymer resin sodium salt, polyacrylic acid sodium salt, polyethylene glycol alkyl ethers and polyethylene glycol alkyl phenyl ethers may be added, as a stabilizer, to an aqueous solution of the lubricant according to the present invention.

The lubricant according to the present invention, in the form of an aqueous solution, may be fed to tools, for example to the guide shoe surface, or to materials to be worked, for example to the billet surface. It is only necessary that the lubricant should exist in the interface where the tool and the material under working are in contact with each other.

EXAMPLES

Using lubricants having the respective compositions specified in Table 1, piercing-rolling was carried out on a Mannesmann piercer. The conditions employed were as follows.

Billets pierced: 13% Cr-containing billets for oil well pipe manufacture, 225 mm in diameter and 3000 mm in length.

Piercer: Skew roll type piercer.

Guide shoes: Disk rolls, 2800 mm in diameter and 150 mm in width.

Hollow shells after piercing: Outside diameter 230 mm, wall thickness 21.0 mm, length 9000 mm.

Lubricant feeding: Spraying over the disk roll surface at a discharge pressure of 0.5 MPa.

Each lubricant composition shown in Table 1 was added to water in the amount of 500 grams per liter of water, and further, a stabilizing agent (sodium naphthalenesulfonate-formaldehyde condensate) was added to the resulting aqueous solution in an amount of 50 grams per liter of the aqueous solution.

In the above piercing operations, observations were made as to whether the feedability of the lubricant was positive or negative and whether the operability was positive or negative and, after piercing, the occurrence of damages due to sticking was examined by inspecting the guide shoe surfaces. The results thus obtained are shown in Table 1.

Shown under "anti-sticking performance" in Table 1 are the results obtained by examination after piercing of 50 billets in each test. The mark "○" indicates that no damages due to sticking was found on the guide shoes, "Δ" indicates that slight a damage due to sticking were found, and "x" indicates that large a damage due to sticking were found.

As for the "feedability", "○" indicates that no spray nozzle clogging occurred at all during piercing of 100 billets, "Δ" indicates that clogging occurred once or twice, and "x" indicates that clogging occurred three times or more frequently.

As for the "operability", "○" indicates that none of 100 billets pierced was misrolled, and "x" indicates that at least one billet was misrolled due to roll slipping.

Shown under "corrosion resistance" are the results of macroscopic observation of 50 products after pickling to check the presence or absence of abnormal surface corrosion (acid roughening): "○" indicates that no acid roughening occurred at all, and "x" indicates that acid roughening was confirmed upon macroscopic observation.

TABLE 1

| | | Test No. | | | | | | | | | | | | | | | |
|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 |
| Components (mass %) *1 | Iron oxide | 70 | 85 | 65 | 60 | 65 | 65 | 55 | 40 | 85 | 45 | 65 | 65 | 65 | 60 | 60 | 60 |
| | Sodium silicate *2 | 30 | 15 | 30 | 35 | 33 | 25 | 20 | 55 | 10 | 35 | 25 | 25 | 25 | 25 | 25 | 25 |
| | Calcium oxide | 0 | 0 | 5 | 5 | 2 | 10 | 25 | 5 | 5 | 20 | 6 | 5 | 5 | 5 | 5 | 5 |
| | Zinc oxide | 0 | 0 | 0 | 0 | 0 | 0 | 0 | 0 | 0 | 0 | 4 | 3 | 0 | 10 | 0 | 0 |
| | Lead oxide | 0 | 0 | 0 | 0 | 0 | 0 | 0 | 0 | 0 | 0 | 0 | 2 | 0 | 0 | 10 | 0 |
| | Copper oxide | 0 | 0 | 0 | 0 | 0 | 0 | 0 | 0 | 0 | 0 | 0 | 0 | 5 | 0 | 0 | 10 |
| | Total | 100 | 100 | 100 | 100 | 100 | 100 | 100 | 100 | 100 | 100 | 100 | 100 | 100 | 100 | 100 | 100 |
| Test result | Anti-sticking performance | Δ | x | ○ | ○ | ○ | ○ | ○ | x | x | x | ○ | ○ | ○ | ○ | ○ | ○ |
| | Feedability | ○ | x | ○ | ○ | ○ | ○ | ○ | ○ | x | ○ | ○ | ○ | ○ | ○ | ○ | ○ |
| | Operability | ○ | ○ | ○ | ○ | ○ | ○ | x | ○ | ○ | ○ | ○ | ○ | ○ | ○ | ○ | ○ |

TABLE 1-continued

| | Test No. | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| Corrosion resistance | ○ | ○ | ○ | ○ | ○ | ○ | ○ | ○ | ○ | ○ | ○ | ○ | ○ | x | x | x |
| Total performance | Δ | x | ○ | ○ | ○ | ○ | x | x | x | x | ○ | ○ | ○ | x | x | x |

*1 Each component shows its content in mass % to the total components in an anhydrous condition, excluding the stabilizer

*2 Water glass No. 1, water glass No. 3 or water glass No. 4

Note:

Each test was executed in an aqueous solution including a slight stabilizer.

As shown in Table 1, the lubricants in Test No. 3 to No. 6 and No. 11 to No. 13, which satisfied the conditions specified herein, all showed good performance characteristics. On the contrary, the lubricants in Test No. 8 and No. 10, low in iron oxide content, were poor in anti-sticking effect. On the other hand, the lubricants in Test No. 2 and No. 9, excessively high in iron oxide content, were inferior in feedability. The lubricant in Test No. 6, excessively low in sodium silicate content, was insufficient in feedability, and the lubricant in Test No. 8, which was excessively high in sodium silicate content, was inferior in anti-sticking effect.

The lubricant in Test No. 1, which contained no calcium oxide, was unsatisfactory in anti-sticking effect, whereas the lubricant in Test No. 7, which was excessive in calcium oxide, caused gripping failure due to slippage, which raised an operability problem. Further, the lubricants in Test No. 14, No. 15 and No. 16, which were high in the content of oxide such as zinc oxide, exerted unfavorable influences on the corrosion resistance of the products.

INDUSTRIAL APPLICABILITY

The lubricant according to the present invention is excellent in lubricating properties and also produces a marked effect in preventing sticking. In addition, it is excellent in feedability and operability, and exerts no adverse effects on the corrosion resistance of the products. Therefore, it is effective as a lubricant for various hot plastic working processes and is very much suited for preventing damages due to sticking from occurring on guide shoes in hot piercing of hard-workable materials such as steel species containing 8 to 25% by mass of Cr, in particular.

The invention claimed is:

1. A lubricant for hot plastic working during steel pipe manufacturing which is characterized in that the composition is comprised of 50 to 80% by mass of iron oxide, 20 to 50% by mass of sodium silicate and 1 to 20% by mass of calcium oxide wherein the concentrations are based on the total concentration of the solid components, and that the total content of the impurities of zinc oxide, lead oxide and copper oxide is not higher than 5% by mass, where the content of the stabilizer is not counted.

* * * * *